US010899569B2

(12) United States Patent
Nishizawa et al.

(10) Patent No.: US 10,899,569 B2
(45) **Date of Patent: *Jan. 26, 2021**

(54) APPARATUS FOR CONVEYING MOLDED BODY FOR FLATTENED TUBE FINS

(71) Applicant: HIDAKA SEIKI KABUSHIKI KAISHA, Tokyo (JP)

(72) Inventors: Junichi Nishizawa, Tokyo (JP); Keiichi Morishita, Tokyo (JP)

(73) Assignee: HIDAKA SEIKI KABUSHIKI KAISHA, Tokyo (JP)

( * ) Notice: Subject to any disclaimer, the term of this patent is extended or adjusted under 35 U.S.C. 154(b) by 156 days.

This patent is subject to a terminal disclaimer.

(21) Appl. No.: 16/082,474

(22) PCT Filed: Oct. 20, 2016

(86) PCT No.: PCT/JP2016/081053

§ 371 (c)(1),
(2) Date: Sep. 5, 2018

(87) PCT Pub. No.: WO2018/073927

PCT Pub. Date: Apr. 26, 2018

(65) Prior Publication Data

US 2020/0115180 A1 Apr. 16, 2020

(51) Int. Cl.
*B65H 20/20* (2006.01)

(52) U.S. Cl.
CPC ..... *B65H 20/20* (2013.01); *B65H 2404/65* (2013.01); *B65H 2555/24* (2013.01); *B65H 2701/173* (2013.01)

(58) Field of Classification Search
CPC ..... B65H 20/20; B65H 20/22
See application file for complete search history.

(56) References Cited

U.S. PATENT DOCUMENTS

| | | | | |
|---|---|---|---|---|
| 5,139,190 | A | 8/1992 | Ferguson | |
| 10,583,990 | B2 * | 3/2020 | Nishizawa | B65G 29/00 |
| 2013/0134203 | A1 | 5/2013 | Karasawa et al. | |

FOREIGN PATENT DOCUMENTS

| | | | |
|---|---|---|---|
| JP | S48-6634 | A | 1/1973 |
| JP | 54043411 | U * | 3/1979 |

(Continued)

OTHER PUBLICATIONS

Machine Translation of JP 01-288557 A, Nov. 20, 1989. (Year: 1989).*

(Continued)

*Primary Examiner* — William E Dondero
(74) *Attorney, Agent, or Firm* — Birch, Stewart, Kolasch & Birch, LLP

(57) ABSTRACT

A conveying apparatus can achieve high-speed conveyance of a molded body for flattened tube fins, prevent generation of noise during conveyance, and have a smaller size. A conveying apparatus conveys a molded body for flattened tube fins obtained by providing a metal thin plate with cutaway portions, before the metal thin plate is cut into a predetermined length. The conveying apparatus includes a rotary conveying body including a plurality of protrusions that are tapered and able to enter the cutaway portions, and including a rotation shaft in a direction orthogonal to a conveying direction of the molded body for flattened tube fins in a horizontal plane, and a rotary conveying body driving unit that rotates and drives the rotary conveying body. A side surface shape of each of the protrusions is formed to have a shape to enable the protrusion to enter the corresponding cutaway portion with a space maintained in synchronization with a rotation of the rotation shaft, and retract from the cutaway portion while the protrusion comes (Continued)

in contact with the cutaway portion and conveys the molded body for flattened tube fins.

5 Claims, 14 Drawing Sheets

(56) References Cited

FOREIGN PATENT DOCUMENTS

| | | | |
|---|---|---|---|
| JP | H01-288557 | A | 11/1989 |
| JP | 5-155490 | A | 6/1993 |
| JP | H02-251944 | A | 10/1993 |
| JP | 2006-021876 | A | 1/2006 |
| JP | 2013-110232 | A | 6/2013 |
| JP | 2013-111600 | A | 6/2013 |
| KR | 10-1625395 | B2 | 6/2016 |

OTHER PUBLICATIONS

Korean Office Action for Korean Application No. 10-2018-7028902, dated Jun. 29, 2019, with English translation.
International Search Report for PCT/JP2016/081053 (PCT/ISA/210) dated Jan. 10, 2017.

* cited by examiner

A-A CROSS SECTION

APPARATUS FOR CONVEYING MOLDED BODY FOR FLATTENED TUBE FINS

TECHNICAL FIELD

The present invention relates to an apparatus for conveying a molded body for flattened tube fins having a plurality of cutaway portions.

BACKGROUND ART

A heat exchanger such as an air conditioner is generally formed by stacking a plurality of heat exchanger fins. The heat exchanger fin has a plurality of through-holes or cutaway portions through which heat exchange tubes are inserted.

Such heat exchanger fins can be manufactured by using an apparatus for manufacturing heat exchanger fins as illustrated in FIG. 15.

An apparatus 200 for manufacturing heat exchanger fins includes an uncoiler 212 where a metal thin plate 210 of aluminum or the like as a thin-plate material has been wound into a coil shape. The metal thin plate 210 pulled out from the uncoiler 212 via pinch rollers 214 is inserted into an oil application device 216 where machining oil is applied on a surface of the metal thin plate 210. Then, the metal thin plate 210 is supplied to a mold 220 that is provided in a mold press unit 218.

The mold 220 includes an upper die set 222 that is vertically movable in an internal space of the mold 220, and a lower die set 224 that is in a stationary state. By this mold 220, a plurality of cutaway portions or collared through-holes provided with collars having a predetermined height around the through-holes are formed at predetermined intervals in predetermined directions (arranged in matrix).

The metal thin plate 210 having the through-holes or cutaway portions, for example, is hereinafter referred to as a metal strip 211.

The metal strip 211 processed in this manner, in which a plurality of heat exchanger fins to be a product are arranged in a width direction, is formed.

An inter-row slit device 225 is therefore provided at a downstream position relative to the mold 220. After the metal strip 211 is formed by the mold press unit 218, the metal strip 211 is fed intermittently by a feeding device 226 to the inter-row slit device 225. The inter-row slit device 225 cuts the metal strip 211 by an upper blade 225A and a lower blade 225B that engage with each other, so that the metal strip 211 has a predetermined product width. Thus, a product-width metal strip 211A that has a strip shape being long in a conveying direction can be formed.

The product-width metal strip 211A formed by the inter-row slit device 225 is cut to have a predetermined product length by a cutter 227, and thus, heat exchanger fins 213 as final products are formed. The heat exchanger fins 213 formed in this manner are housed in a stacker 228. In the stacker 228, a plurality of pins 229 are provided to stand up in a vertical direction, and the heat exchanger fins 213 are stacked and held in the stacker 228 in a manner that the pins 229 are inserted into the through-holes or the cutaway portions of the heat exchanger fins 213.

CITATION LIST

Patent Literature

PTL1: Japanese Patent Application Laid-open No. 2006-21876

SUMMARY OF INVENTION

Technical Problem

In the conventional apparatus 200 for manufacturing heat exchanger fins, the feeding device 226 conveys the metal strips 211 formed by the mold 220 (mold press unit 218) by an intermittent feeding mechanism, what is called a hitch feeding mechanism.

In the intermittent feeding mechanism typified by the hitch feeding mechanism, when the metal strips 211 are conveyed, a hitch pin needs to be inserted into the metal strip 211 and when the hitch feeding mechanism is returned from the conveying direction of the metal strip 211, the hitch pin needs to be retracted from the metal strip 211; thus, there has been a restriction in increasing the speed of conveying the metal strips 211.

Moreover, if the metal strips 211 are conveyed using the hitch feeding mechanism at high speed, components of the hitch feeding mechanism may collide with each other to generate noise or be damaged.

In particular, the metal strip having the cutaway portions where the flattened tubes as the heat exchanger tubes are inserted is weaker than the metal strip having the through-holes where round heat exchanger tubes are inserted because the cut opening side is weak. Thus, it is considered that, for example, the collision between the components of the hitch feeding mechanism has a large influence on the conveyance, and therefore a structure in which the collision between the components of the hitch feeding mechanism has a smaller influence on the conveyance has been expected.

In view of the above, the present invention has been made to solve the problem, and has an object of enabling the high-speed conveyance of a molded body for flattened tube fins that is formed by a mold, and preventing deformation of the molded body for flattened tube fins and generation of noise during conveyance of the molded body for flattened tube fins by stable and accurate conveyance.

Solution to Problem

An apparatus for conveying a molded body for flattened tube fins according to the present invention is a conveying apparatus that, in manufacturing flattened tube fins having cutaway portions through which flattened tubes for exchanging heat are inserted, conveys in a predetermined direction a molded body for flattened tube fins obtained by providing a metal thin plate with the cutaway portions, before the metal thin plate is cut into a predetermined length in a conveying direction. The apparatus includes: a rotary conveying body including a plurality of protrusions that are tapered and able to enter the cutaway portions, and including a rotation shaft in a direction orthogonal to the conveying direction of the molded body for flattened tube fins in a horizontal plane; and a rotary conveying body driving unit that rotates and drives the rotary conveying body about the rotation shaft. A side surface shape of each of the protrusions is formed to have a shape to enable the protrusion to enter the corresponding cutaway portion with a space maintained in synchronization with a rotation of the rotation shaft, and retract from the cutaway portion while the protrusion comes in contact with the cutaway portion and conveys the molded body for flattened tube fins.

This structure can eliminate the necessity of using the hitch feeding mechanism. Thus, the molded body for flattened tube fins can be conveyed at high speed without generating the noise or damaging the components In addition, at least a part of the side surface shape of the protrusion may be formed by an involute curve.

Moreover, a lower guide plate that supports a lower surface of the molded body for flattened tube fins, and an upper guide plate that covers an upper surface of the molded body for flattened tube fins may be provided.

This structure can prevent the molded body for flattened tube fins from fluttering in the conveyance of the molded body for flattened tube fins. Furthermore, the depth where the protrusion enters the cutaway portion provided to the molded body for flattened tube fins can be made constant, and thus, the molded body for flattened tube fins can be conveyed stably.

In addition, the rotary conveying body driving unit may be a servomotor, and the servomotor may have a rotation shaft that is directly connected to the rotation shaft of the rotary conveying body.

This structure can easily change the conveying distance by controlling the rotation angle of the servomotor. Furthermore, the structure can be reduced in cost and size.

Moreover, the rotary conveying body driving unit may use, as a motive power source, rotation motive power from a crank shaft that performs a mold pressing operation of a mold for forming the cutaway portions.

Advantageous Effects of Invention

According to the present invention, the high-speed conveyance of a molded body for flattened tube fins can be performed, and deformation of the molded body for flattened tube fins and generation of noise during the conveyance of the molded body for flattened tube fins can be prevented by stable and accurate conveyance.

DESCRIPTION OF EMBODIMENTS

First Embodiment

Figure 1:
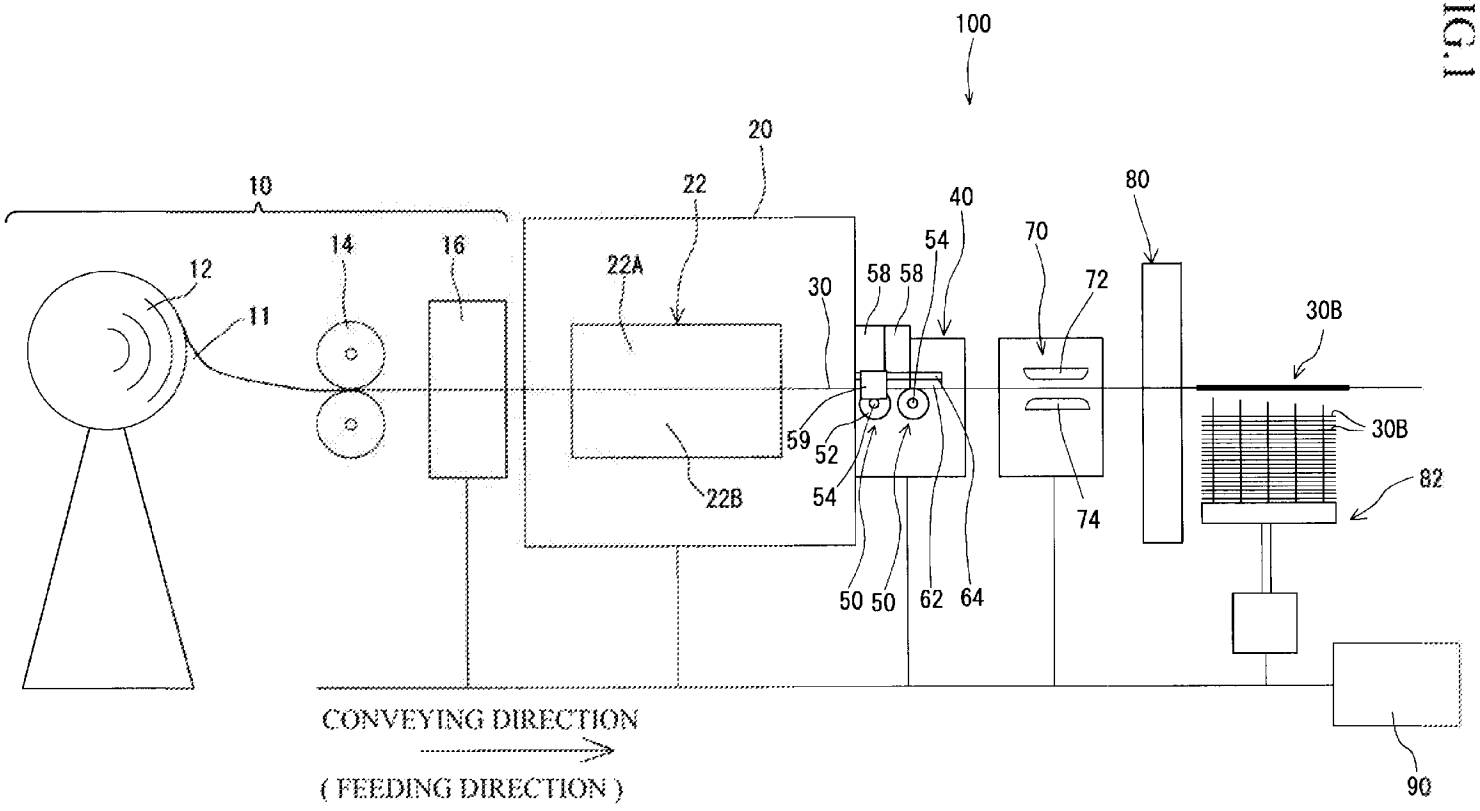
FIG. 1 is a side view illustrating an entire structure of an apparatus for manufacturing flattened tube fins.

An overall structure of an apparatus 100 for manufacturing flattened tube fins is illustrated in FIG. 1. Flattened tube fins are formed in a manner that a metal strip obtained by pressing a metal thin plate 11 in a mold press unit 20 is molded so as to have a product width and a product length of the flattened tube fins.

Moreover, a molded body for flattened tube tins refers to a concept covering both a metal strip obtained by pressing the metal thin plate 11 in the mold press unit 20 and a product-width metal strip obtained by dividing the metal strip by a product width of the flattened tube fins.

In other words, the molded body for flattened tube tins refers to a metal strip obtained by providing the metal thin plate 11 with cutaway portions, before the metal thin plate 11 is cut into a predetermined length (before cut into a product length) in a conveying direction.

The metal thin plate 11 that is formed of aluminum or the like as a material of the molded body for flattened tube fins and that is not processed yet has been wound around an uncoiler 12 in a coil shape. The metal thin plate 11 is pulled out from the uncoiler 12 and then further pulled out via pinch rollers 14. Next, machining oil is applied on the metal thin plate 11 by an oil application device 16 and then, the metal thin plate 11 is intermittently fed to the mold press unit 20 that has a mold 22 inside. Here, the uncoiler 12, the pinch rollers 14, and the oil application device 16 constitute a material supply unit 10. The structure of the material supply unit 10 is just an example and is not limited to the structure described in the present embodiment.

The mold 22 according to the present embodiment includes the upper die set 22A and the lower die set 22B, and the upper die set 22A is provided to be capable of contacting or separating from the lower die set 22B. By the mold press unit 20 including the mold 22 as above, a molded body 30 for flattened tube fins having tube insertion portions 31 as cutaway portions through which flatten tubes for exchanging heat are inserted into the metal thin plate 11 is formed.

Figure 2:
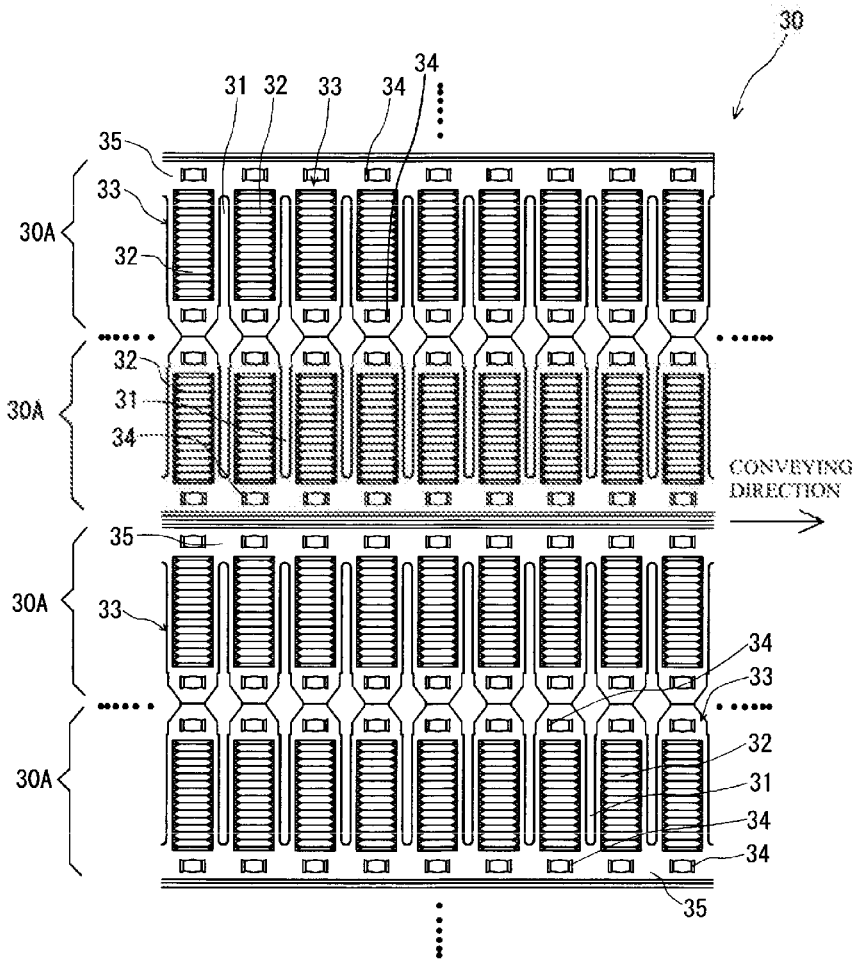
FIG. 2 is a plan view of a molded body for flattened tube fins.

FIG. 2 illustrates the molded body 30 for flattened tube fins that is formed by the mold 22. The molded body 30 for flattened tube fins illustrated in FIG. 2 includes a group of products arranged in a plurality of rows in a width direction that is orthogonal to a predetermined conveying direction (direction indicated by a lateral arrow in FIG. 2) in a horizontal plane.

The molded body 30 for flattened tube fins is continuous in the conveying direction and in the direction orthogonal to the conveying direction in the horizontal plane, and FIG. 2 illustrates a part of the molded body 30 for flattened tube fins.

For the molded body 30 for flattened tube fins, the tube insertion portions 31 are provided at a plurality of positions on each of products obtained by separating the molded body 30 for flattened tube fins into pieces. To the tube insertion portions 31, the flattened tubes are inserted and cause a heat exchange medium to flow.

Between the tube insertion portion 31 and another tube insertion portion 31, a plate-shaped portion 33 having a louver 32 is formed. Each end of the louver 32 in a width direction is provided with a cut and raised part 34. The cut and raised part 34 is formed by cutting and raising a part of the plate-shaped portion 33.

Of two cut and raised parts 34 and 34 for one louver 32, one cut and raised part 34 is formed on a tip end side of the plate-shaped portion 33.

The tube insertion portion 31 is formed only from one side in the width direction of a flattened tube fin 30A as a final product. Therefore, the plate-shaped portions 33 between the tube insertion portion 31 and the tube insertion portion 31 are connected by a connector 35 that extends in a longitudinal direction.

Of the two cut and raised parts 34 and 34 for one louver 32, the other cut and raised part 34 is formed on the connector 35. Here, in the areas that are not subjected to pressing in the plate-shaped portion 33 and the connector 35, an area continuous in the conveying direction of the molded body 30 is regarded as a flat area of the molded body 30 for flattened tube fins (hereinafter also simply referred to as a flat area).

Of the molded body 30 for flattened tube fins illustrated in FIG. 2, two flattened tube fins 30A that are disposed to face each other so that openings of the tube insertion portions 31 come adjacent to each other constitute one set, and two sets are formed. In other words, the sets that are disposed so that the opening sides of the tube insertion portions 31 of the two products lace each other are provided with their connectors 35 adjacent to each other.

Now, the description of the overall structure of the apparatus 100 for manufacturing flattened tube fins is continued. The molded body 30 for flattened tube fins formed by the mold 22 housed in the mold press unit 20 is conveyed intermittently in a predetermined direction (here, toward an inter-row slit device 70) by a conveying apparatus 40 that is provided on the downstream side relative to the mold press unit 20.

The feeding timing of the conveying apparatus 40 is controlled by an operation control unit 90 to be described below so that the conveying apparatus 40 operates in synchronization with (in conjunction with) the operation of the mold press unit 20, and thus stable intermittent feeding is possible.

Figure 3:
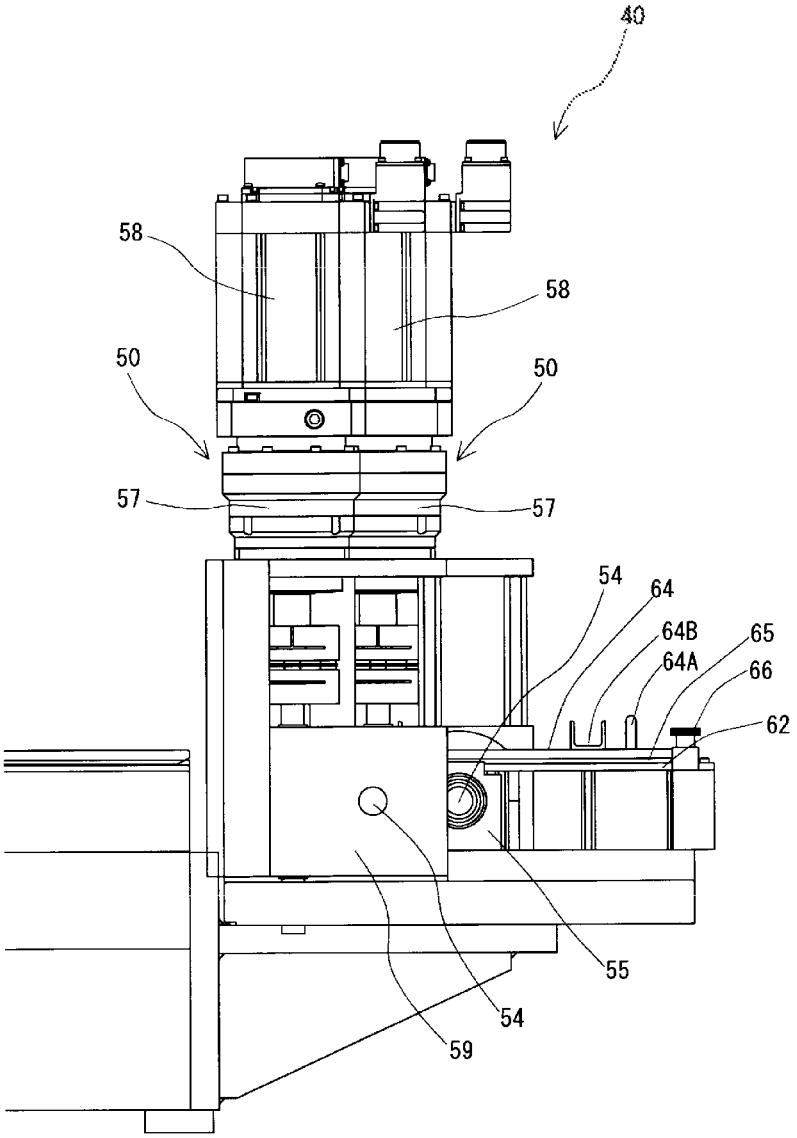
FIG. 3 is a side view of a conveying apparatus according to a first embodiment.
Figure 4:
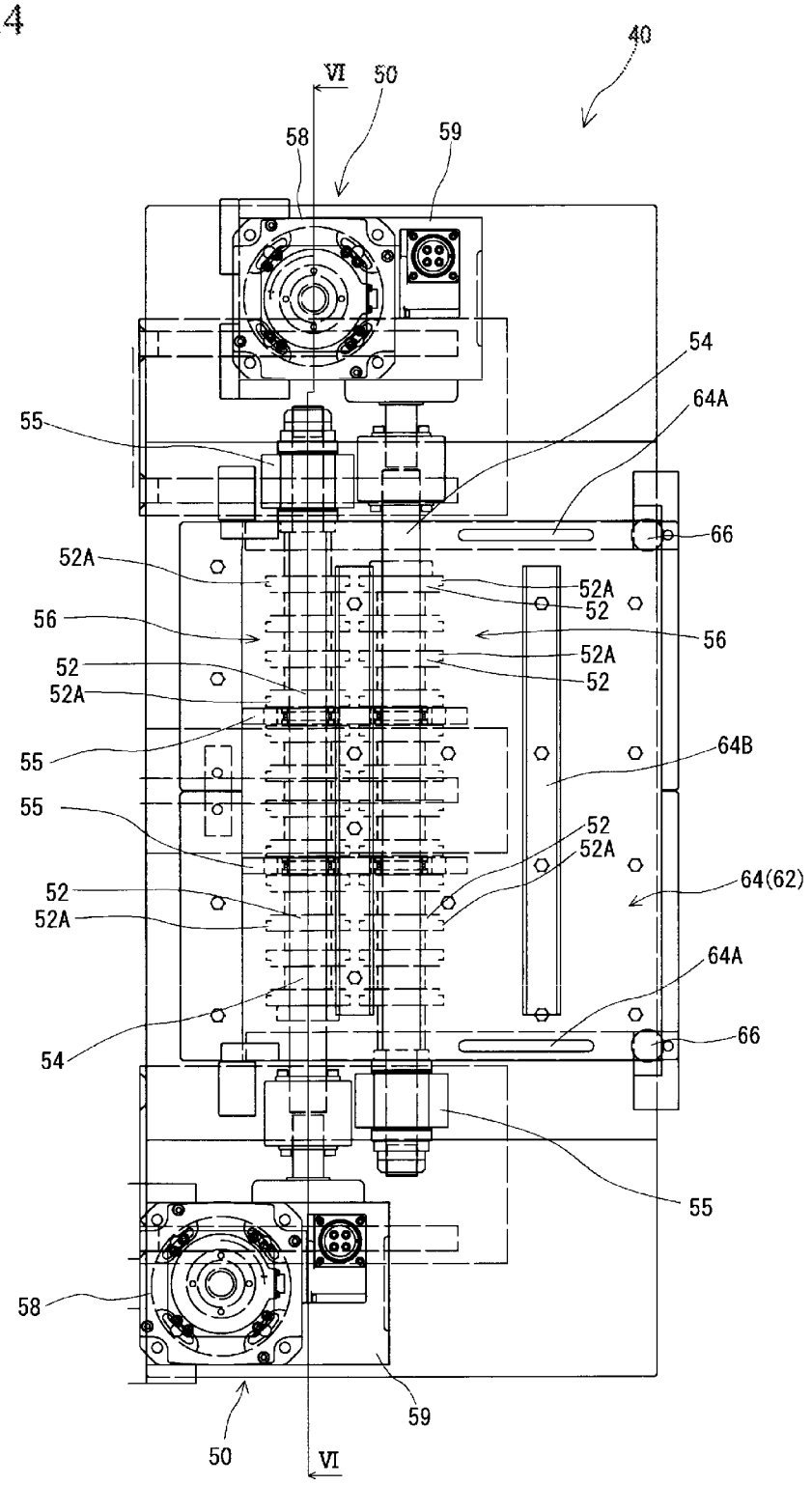
FIG. 4 is a plan view of the conveying apparatus according to the first embodiment.
Figure 5:
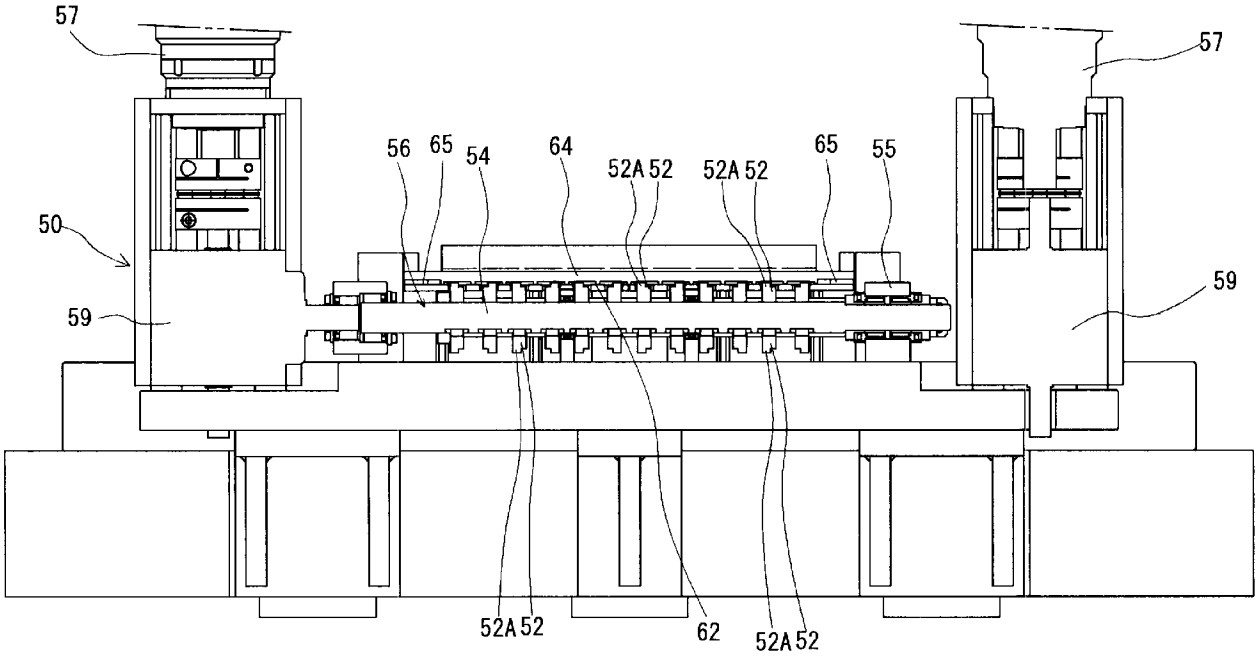
FIG. 5 is a front view of the conveying apparatus according to the first embodiment.
Figure 6:
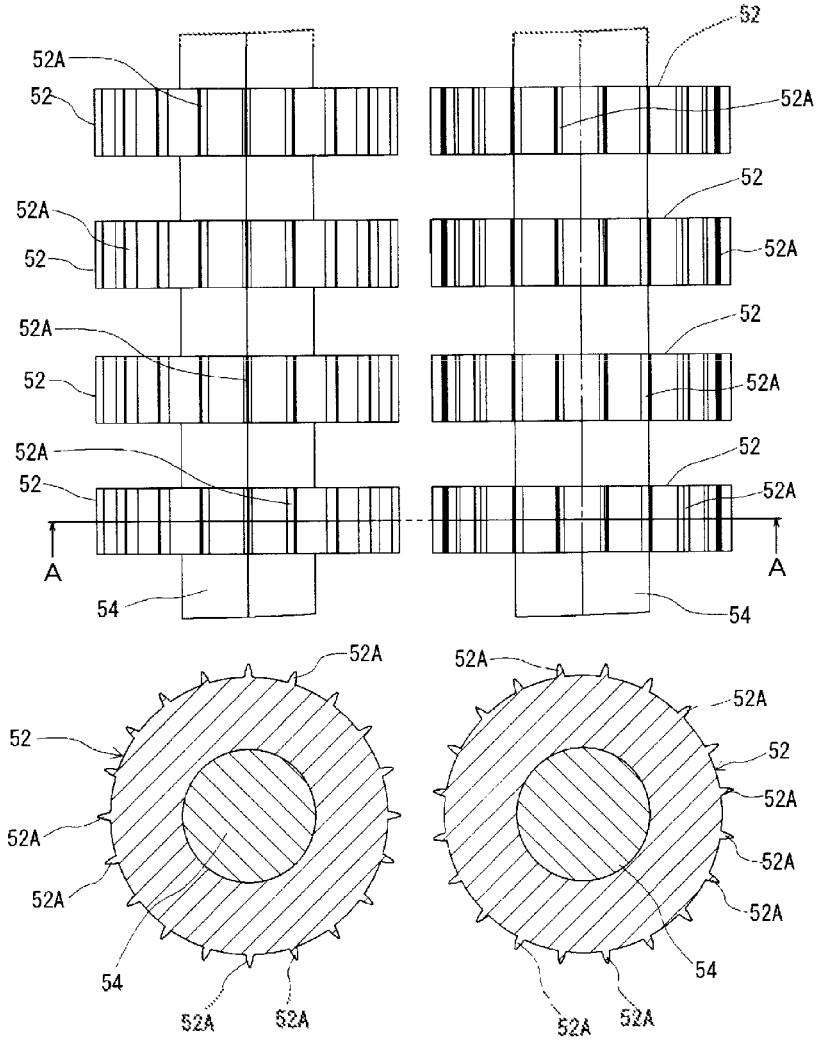
FIG. 6 is an explanatory view illustrating a state of a protrusion of a rotary disk for every conveying unit.

FIG. 3 is a side view of the conveying apparatus 40, FIG. 4 is a plan view of the conveying apparatus 40, and FIG. 5 is a front view of the conveying apparatus 40. In addition, FIG. 6 is an explanatory view illustrating a state of protrusions 52A of a rotary conveying body 56 included in a conveying unit 50.

The conveying apparatus 40 in the present embodiment includes a plurality of conveying units 50 that are provided at predetermined intervals in the conveying direction of the molded body 30 for flattened tube fins.

Each of the conveying units 50 in the present embodiment includes the rotary conveying body 56, and a rotary conveying body driving unit 58 that rotates and drives the rotary conveying body 56 around a rotation shaft that is orthogonal to the conveying direction of the molded body 30 for flattened tube fins in the horizontal plane.

The rotary conveying body 56 includes a plurality of rotary disks 52 each having the protrusions 52A on an outer peripheral surface, and rotation shafts 54 that each penetrate a central part of a main plane of each of the rotary disks 52 and extend in a direction orthogonal to the conveying direction of the molded body 30 for flattened tube fins in the horizontal plane.

The number of the rotary disks 52 provided to each of the rotation shafts 54 is equal to or smaller than the number of the tube insertion portions 31 formed in the width direction of the molded body 30 for flattened tube fins.

Figure 7:
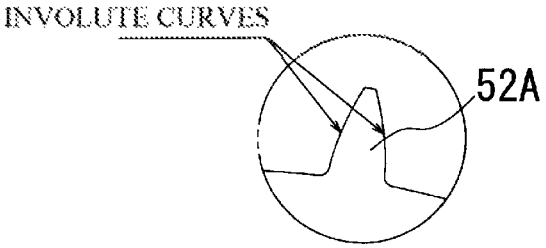
FIG. 7 is a magnified view of the protrusion to be inserted into a tube insertion portion.

FIG. 7 is a magnified view of the protrusion 52A.

The protrusions 52A are provided on the outer peripheral surface of the rotary disk 52, protruding in the radial direction.

Each of the protrusions 52A has a function of, by being inserted into the tube insertion portion 31 of the molded body 30 for flattened tube fins, pulling the molded body 30 for flattened tube fins as the rotary conveying body 56 rotates.

The protrusion 52A is formed so as to have what is called a tapered shape, that is, the shape is gradually narrowed (toward an upper end side) as it rises from the outer peripheral surface of the rotary disk 52 (base part).

A side surface of the protrusion 52A has a shape to enable the protrusion 52A to enter the tube insertion portion 31 with a space maintained in synchronization with the rotation of the rotation shaft 54, and retract from the tube insertion portion 31 while the protrusion 52A comes in contact with the tube insertion portion 31 and conveys the molded body for flattened tube fins.

More specifically, in regard to the protrusion 52A to be inserted into the tube insertion portion 31, at least a part of an outer surface of the protrusion 52A that comes to the front side (downstream side in the conveying direction of the flattened tube fins) in the rotating direction when the rotary disk 52 conveys the molded body 30 for flattened tube fins is formed by an involute curve. In FIG. 6, however, both a front surface side and a rear surface side of the outer surface of the protrusion 52A are formed by the involute curve.

The shape of the outer surface of the protrusion 52A is not limited to the involute curve.

The front surface side of the outer surface of the protrusion 52A is formed by the involute curve. Thus, when the rotary disk 52 is rotated to make the protrusion 52A enter the tube insertion portion 31 gradually, the contact resistance between the outer surface of the protrusion 52A and an inner wall surface of the tube insertion portion 31 can be reduced to enable the smooth entry of the protrusion 52A.

In addition, when the protrusion 52A retracts from the tube insertion portion 31 by the rotation of the rotary disk 52, the contact resistance between the outer surface of the protrusion 52A and the inner wall surface of the tube insertion portion 31 can be reduced to enable the smooth retraction of the protrusion 52A.

The angle intervals of providing the protrusions 52A on the outer peripheral surface of the rotary disk 52 are preferably determined so that the value obtained by dividing the interval angle of the protrusions 52A on the outer peripheral surface of the rotary disk 52 by the number of conveying units 50 (the number of driving shafts) is 14 degrees or less.

According to the experiments of the present applicant, the following fact has been clarified by employing such angle intervals of the protrusions 52A: the positioning of the molded body 30 for flattened tube fins can be performed certainly because the protrusion 52A enters the tube insertion portion 31 before the previous protrusion 52A provided to the rotary disk 52 retracts completely from the tube insertion portion 31; thus, the molded body 30 for flattened tube fins can be smoothly conveyed.

In each of the conveying units 50, as illustrated in FIG. 6, the positions of the protrusions 52A in the rotary disks 52 are on respective straight lines in a longitudinal direction of the rotation shaft 54. In other words, when the rotary conveying body 56 (rotation shaft 54) is rotated, all the timings when the protrusions 52A pass a particular position in the rotating direction of the rotary conveying body 56 are the same in a longitudinal direction of the rotary conveying body 56. By employing the conveying units 50 with the same structure formed in this manner, the timings when the protrusions 52A in the conveying units 50 become orthogonal to the conveying plane (horizontal plane) can be at equal intervals.

Thus, when the conveying units 50 convey the molded body 30 for flattened tube fins, the protrusions 52A can enter or retract from the tube insertion portions 31 at the same timing in a width direction of the molded body 30 for flattened tube fins. Thus, the load on the tube insertion portions 31 when the molded body 30 for flattened tube fins is conveyed can be diffused; therefore, deformation of the molded body 30 for flattened tube fins can be prevented. These are convenient in that the conveying speed of the molded body 30 for flattened tube fins is increased easily.

In addition, in the present embodiment, servomotor is employed as the rotary conveying body driving unit 58 (hereinafter the servomotor is also denoted by 58). The servomotor 58 is disposed so that a rotation shaft thereof directs downward vertically, and the rotation shaft of the servomotor 58 is connected to the rotation shaft 54 through a cam index 59.

In this manner, since the servomotor 58 and the rotation shaft 54 are connected through the cam index 59, the rotation shaft 54 can be rotated and driven intermittently even if the servomotor 58 is driven at a constant speed.

Here, the cam index 59 has a cam profile that synchronizes with a pressing operation of the mold press unit 20. In addition, an output shaft of the cam index 59 is formed to have a cam profile that can repeat conveyance of the molded body 30 for flattened tube fins by a predetermined length in one cycle operation in accordance with the installation state of the protrusions 52A provided to the rotary disk 52.

The cam index 59 preferably has a cam profile that makes the protrusion 52A enter the tube insertion portion 31 of the molded body 30 for flattened tube fins in a state that the protrusion 52A stands up in a direction orthogonal to the conveying plane when one cycle operation of intermittently feeding the molded body 30 for flattened tube fins of the apparatus 100 for manufacturing flattened tube fins ends. This is convenient in that the protrusion enters the tube insertion portion 31 of the molded body 30 for flattened tube fins in an optimal state, so that the molded body 30 for flattened tube fins can be smoothly conveyed at the start of the conveyance and deformation of the molded body 30 for flattened tube fins can be prevented.

The disposition interval (shaft-to-shaft distance) of disposing the conveying units 50 with such a structure may be determined as appropriate and it is preferable to employ the intervals that are calculated in accordance with an expression represented in Table 1.

TABLE 1

$L = P1 \times (M + 1/N)$

L: shaft-to-shaft distance of conveying unit

P1: pitch of molded product (product pitch)

M: arbitrary integer

N: the number of conveying units (the number of shafts of conveying units)

As illustrated in FIG. 4, one end side of the rotation shaft 54 of the conveying unit 50 is connected to the servomotor 58, and the other end side is rotatably held by a holder 55 typified by a bearing holder or the like. The servomotor 58 is connected to the rotation shaft 54 (output shaft of servomotor) through a decelerator 57 and the cam index 59 in a state that the servomotor 58 is disposed in an offset arrangement on the upstream side in the conveying direction relative to the position on the axial line of the center axis (rotation shaft) of the rotation shaft 54 (the servomotor 58 may be disposed in the offset arrangement on the downstream side in the conveying direction).

The conveying units 50 adjacent to each other in the conveying direction of the molded body 30 for flattened tube fins are provided in a manner that the rotary conveying body driving units 58 thereof are alternately disposed in the direction orthogonal to the conveying direction of the molded body 30 for flattened tube fins in the horizontal plane.

By arranging the conveying units 50 in a plane shape in this manner, the servomotors 58 can be disposed close to the mold press unit 20. The width dimensions of the servomotors 58 in the conveying direction can be overlapped with each other partially in the conveying direction of the molded body 30 for flattened tube fins. In other words, the space that the conveying apparatus 40 occupies is reduced, whereby the conveying apparatus 40 can be reduced in size, and therefore the whole apparatus 100 for manufacturing flattened tube fins can be reduced in size.

In addition, in regard to the connection between the servomotor 58 and the rotation shaft 54 in each conveying unit 50, the servomotor 58 may be connected to the rotation shaft 54 through the decelerator 57 and the cam index 59 as described in the present embodiment, the servomotor 58 may be connected to the rotation shaft 54 through the cam index 59 only, the servomotor 58 may be connected to the rotation shaft 54 through the decelerator 57 only, or the output shaft of the servomotor 58 may be directly connected to the rotary conveying body 56 (the rotation shaft 54 thereof).

In other words, how the rotary conveying body 56 (the rotation shaft 54 thereof) and the servomotor 58 are connected is not limited to a particular mode.

Furthermore, the operation of the servomotor 58 in each conveying unit 50 is controlled by the operation control unit 90 so that at least the rotation driving operations of both units synchronize with the pressing operation of the mold press unit 20 (intermittent feeding operation of the molded body 30 for flattened tube fins) (i.e., so that the rotation speeds are synchronized).

In addition, the number of conveying units 50 to be disposed in the conveying apparatus 40, and the timings when the protrusions 52A of the rotary disks 52 in the respective conveying units 50 become orthogonal to the conveying plane (horizontal plane) are preferably at equal intervals. In the present embodiment, the two conveying units 50 constitute the conveying apparatus 40, and therefore, the angle phase difference between the protrusions 52A in the conveying units 50 is set to an angle interval value obtained by dividing the angle interval of the protrusions 52A provided to the rotary disks 52 by 2. In other words, for one rotation shaft 54, the other rotation shaft 54 is connected to the output shaft of the cam index 59 at the position to satisfy the value of the angle interval obtained by dividing the angle interval of the protrusions 52A provided to the rotary disks 52 by 2. Thus, the angle phase difference relative to the state in which the protrusion 52A stands up in the direction orthogonal to the conveying plane is provided.

By providing the angle phase difference to the protrusions 52A in the conveying units 50 as described above, the protrusion 52A of any one conveying unit 50 among the conveying units 50 disposed along the conveying direction can enter or retract from the tube insertion portion 31. This is therefore convenient in that an external force that acts in the conveyance of the molded body 30 for flattened tube fins can be made constant, deformation of the molded body 30 for flattened tube fins can be prevented, and the smooth conveyance can be performed.

Figure 8:
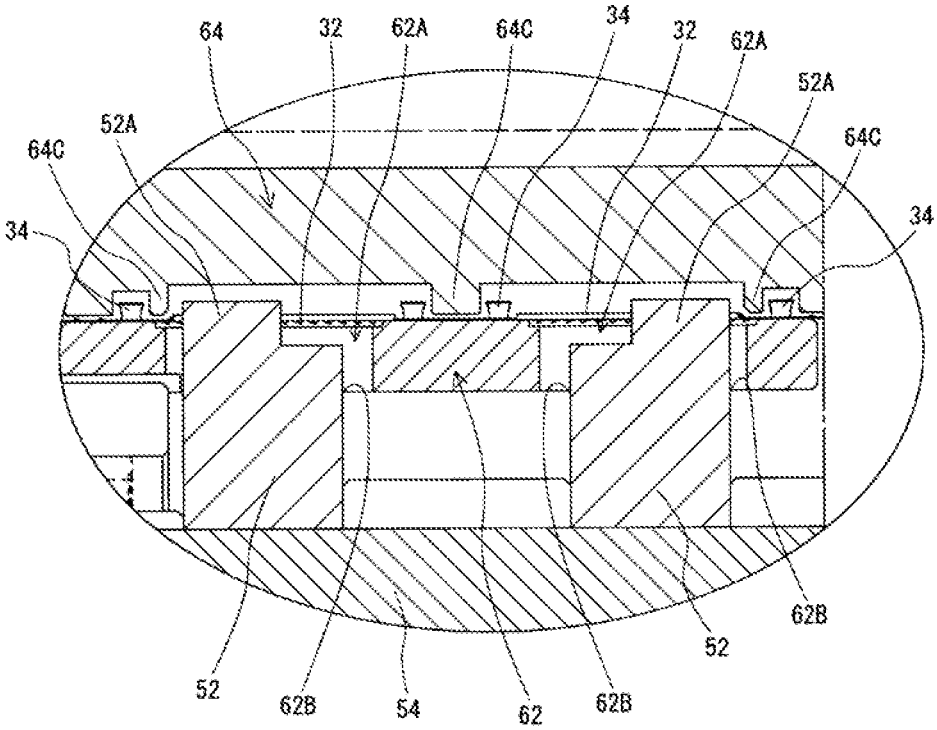
FIG. 8 is a magnified view of a main part of FIG. 5.

As illustrated in FIG. 3 and FIG. 8, in the present embodiment, a lower guide plate 62 is provided at an exit position of the mold press unit 20. The lower guide plate 62 guides a height position of a lower surface of the molded body 30 for flattened tube fins so as to be the same in a predetermined length range (supports the lower surface of the molded body 30 for flattened tube fins).

The lower guide plate 62 is provided in a range from the upstream side to the downstream side of the conveying units 50. The lower guide plate 62 may be integrated or separately provided in an upstream part, an intermediate part, and a downstream part of the conveying unit 50.

An upper surface of the lower guide plate 62 is provided with a concave groove 62A in the present embodiment. The concave groove 62A of the lower guide plate 62 is formed at a position corresponding to a position where the tube insertion portion 31 of the molded body 30 for flattened tube fins is formed and a position corresponding to a position where the louver 32 is formed.

Through the concave groove 62A of the lower guide plate 62, a penetration hole 62B that penetrates in a plate thickness direction is formed. In a state that a part of the protrusion 52A (rotary disk 52) projects from the penetration hole, the rotary disk 52 of the conveying unit 50 is housed. An end part of the protrusion 52A comes to the position above the height position of the upper surface of the lower guide plate 62 when the protrusion 52A stands up relative to the conveying plane (when one cycle operation of intermitting feeding the molded body 30 for flattened tube fins ends).

The concave groove 62A is formed at the position corresponding to the position where the louver 32 of the molded body 30 for flattened tube fins is disposed, thereby preventing the contact between the lower guide plate 62 and the louver 32 when the molded body 30 for flattened tube fins is conveyed.

Above the lower guide plate 62 is provided an upper guide plate 64 that can cover an upper surface of the molded body 30 for flattened tube fins.

The upper guide plate 64 is provided to be able to switch (rotate) between a state in which the upper guide plate 64 overlaps the lower guide plate 62 and another state in which the upper guide plate 64 is flipped at an edge part on the mold press unit 20 side serving as an axis of rotation. When the molded body 30 for flattened tube fins is conveyed usually, the upper guide plate 64 overlaps the lower guide plate 62 with a predetermined space in a plate thickness direction. This space is formed by a spacer 65 disposed between the lower guide plate 62 and the upper guide plate 64.

An upper surface of the upper guide plate 64 has a handle 64A and a reinforcement member 64B attached thereto. When an operator grips the handle 64A and lifts up the upper guide plate 64, the upper guide plate 64 can be flipped from the lower guide plate 62.

A lower surface of the upper guide plate 64 has a convex part 64C that protrudes downward at a corresponding position in the flat area of the molded body 30 for flattened tube fins. In a normal state, a space is formed between the convex part 64C and the flat area of the molded body 30 for flattened tube tins.

In addition, guide plate pressing bolts 66 are provided to fix the upper guide plate 64 and the lower guide plate 62. Tightened with the guide plate pressing bolts 66, the upper guide plate 64 is fixed to the lower guide plate 62 with the spacer 65 interposed therebetween.

In the molded body 30 for flattened tube fins discharged from the mold press unit 20, the convex part 64C of the upper guide plate 64 comes in contact with the flat area of the molded body 30 for flattened tube fins only when a change (fluttering) occurs in the plate thickness direction of the molded body 30 for flattened tube fins; thus, the change can be restricted. This suppresses the variation in depth where the protrusion 52A of the conveying unit 50 enters the tube insertion portion 31 of the molded body 30 for flattened tube fins, and thus, the height position of the conveying plane of the molded body 30 for flattened tube fins can be maintained at a predetermined height position. The restriction of the change in the plate thickness direction of the molded body 30 for flattened tube fins causes the convex part 64C to come in contact with the flat area of the molded body 30 for flattened tube fins; thus, deformation of the molded body 30 for flattened tube fins does not occur.

Note that the inter-row slit device 70 is provided on a downstream side relative to the conveying apparatus 40. The inter-row slit device 70 includes an upper blade 72 disposed on an upper surface side of the molded body 30 for flattened tube fins, and a lower blade 74 disposed on a lower surface side of the molded body 30 for flattened tube fins.

The inter-row slit device 70 may have an independent motive power source, or the inter-row slit device 70 may be operated by using a vertical movement of the mold press unit 20. The upper blade 72 and the lower blade 74 of the inter-row slit device 70 are formed to be long in the conveying direction. The molded body 30 for flattened tube fins that is intermittently fed is cut by the upper blade 72 and the lower blade 74, and thus, molded bodies 30B for flattened tube tins each having a product width and corresponding to an intermediate object of a product that is long in the conveying direction are formed. Here, the inter-row slit device 70 is disposed on the downstream side relative to the conveying apparatus 40 but may alternatively be disposed on the upstream side position relative to the conveying apparatus 40.

The molded bodies 30B for flattened tube fins, which have been cut by the inter-row slit device 70 so as to have the product width, are sent into a cutoff device 80 where the molded bodies 30B for flattened tube fins with the product width are cut into a predetermined length. Thus, flattened tube fins 30A corresponding to a final product can be obtained. The flattened tube fins 30A are stacked in a stack device 82, and every stack of a predetermined number of flattened tube fins 30A is conveyed to a next step where the flattened tube fins 30A are assembled into a heat exchanger that is not illustrated.

The apparatus 100 for manufacturing flattened tube fins according to the present embodiment includes the operation control unit 90 including a CPU and a storage unit (not illustrated). The storage unit of the operation control unit 90 stores operation control programs in advance for performing operation controls over the units included in the apparatus 100 for manufacturing flattened tube fins. The CPU reads the operation control programs from the storage unit, and performs the operation controls over the units in accordance with the operation control programs. By performing the operation controls over the units by the CPU and the operation control programs, a series of operations in the units of the apparatus 100 for manufacturing flattened tube fins can be performed in conjunction.

The operation control unit 90 controls the operation of the rotary conveying body driving units 58 so as to synchronize the rotation operations of the rotation shafts 54 and also synchronize these operations with the rotation of a crank shaft of the mold press unit 20. After one cycle of intermittently feeding the molded body 30 for flattened tube fins (after one cycle operation) ends, any one of the protrusions 52A of each rotary disk 52 stands up in the direction orthogonal to the conveying plane of the molded body 30 for flattened tube fins. Specifically, the output shaft of the cam index 59 and the rotation shall 54 are connected so that the protrusion 52A of the rotary disk 52 stands up at the position where the intermittent operation (one cycle operation) of the cam index 59 starts.

Second Embodiment

Figure 9:
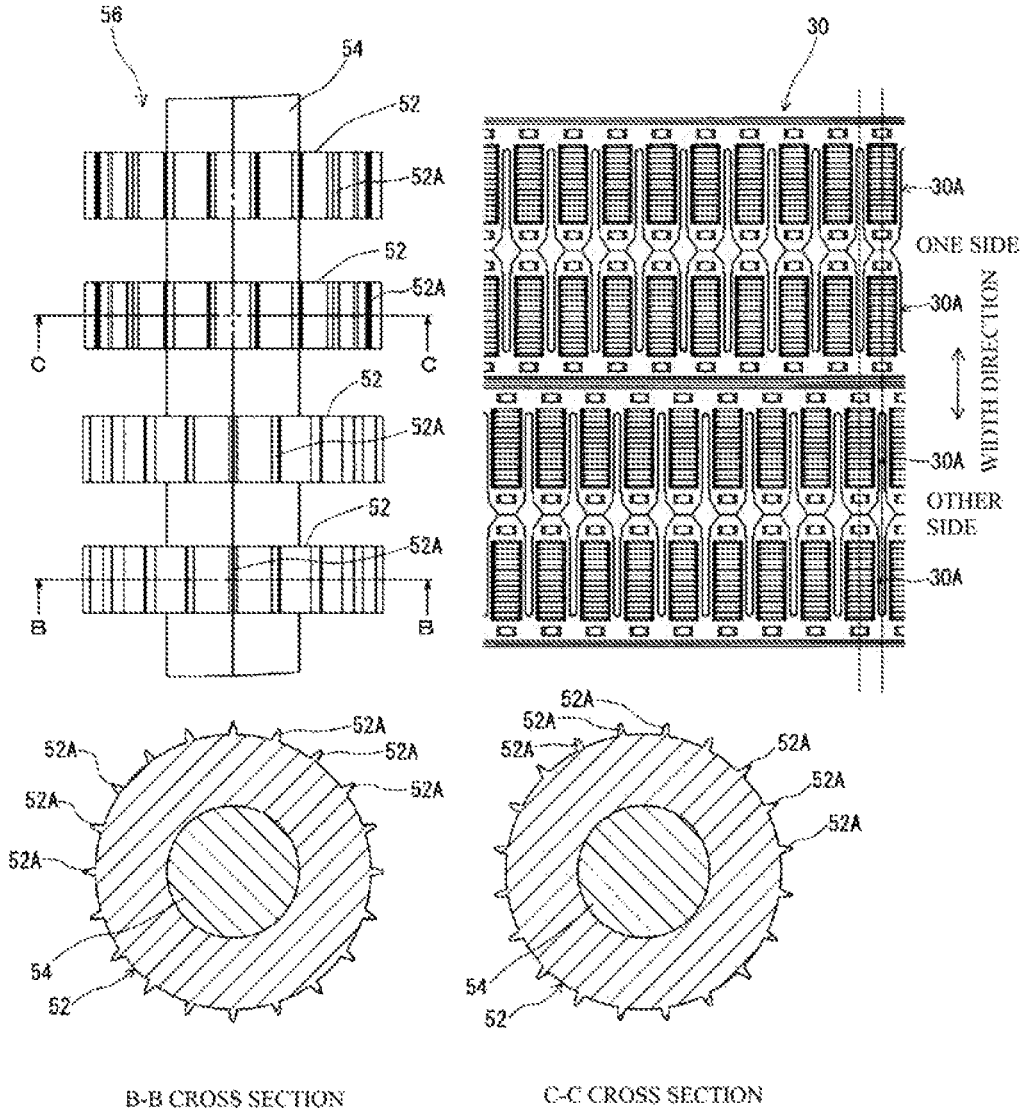
FIG. 9 is a plan view of a metal strip and a conveying unit according to a second embodiment.

FIG. 9 is a plan view of a main part of the molded body 30 for flattened tube fins in a second embodiment, and illustrates a structure of the conveying unit 50 for the molded body 30 for flattened tube fins.

In the molded body 30 for flattened tube fins according to the present embodiment, the pitches of the products on one side (upper half in FIG. 9) in the width direction corresponding to the direction orthogonal to the conveying direction does not coincide with the pitches of the products on the other side (lower half in FIG. 9); thus, the products are in the offset (displaced) state by a half of the product dimension in the conveying direction.

A feature of the present embodiment is the structure of the conveying unit 50 that is disposed at the position of the tube insertion portion 31 of the molded body 30 for flattened tube fins.

Specifically, the installation positions of the protrusions 52A are displaced along the longitudinal direction of the rotation shaft 54 in each of the range of a half on one end side in the longitudinal direction of the rotation shall 54 and the range of the other half. More specifically, when the rotation shaft 54 is viewed in the longitudinal direction, the positions of the protrusions 52A are aligned in a circumferential direction of the rotary disk 52 in each of the range of a half on one end side of the rotation shaft 54 and the range of the other half.

In other words, to a mountain part of the outer periphery of the rotary disk 52 in a half on one end side of the rotation shaft 54 (position where the protrusion 52A is disposed), a valley part (intermediate position between the protrusion 52A and the protrusion 52A) of the outer peripheral surface of the rotary disk 52 in the other half is positioned. The operation effect similar to that of the first embodiment can be obtained when two rotation shafts 54 including the rotary disks 52 illustrated in FIG. 9 are disposed at predetermined intervals in the conveying direction of the molded body 30 for flattened tube fins.

Third Embodiment

The above embodiments have described the molded body 30 for flattened tube fins of what is called a ribbon type, in which the flattened tube fins 30A are formed in the direction orthogonal to the conveying direction in the same plane within the conveying plane.

Figure 10:
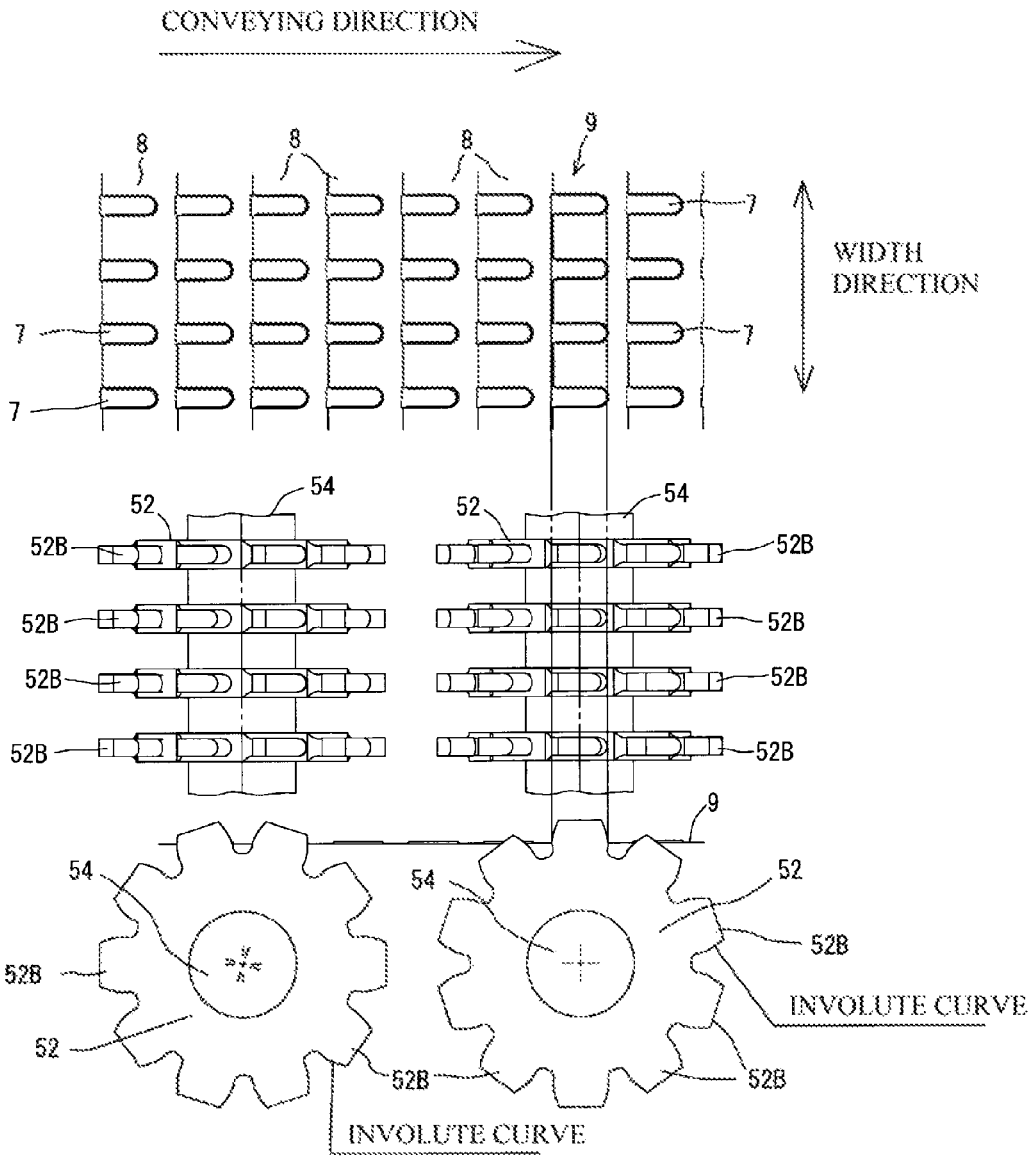
FIG. 10 is an explanatory view illustrating a metal strip and a conveying unit according to a third embodiment.

However, as illustrated in FIG. 10, the present invention is also applicable to a molded body 9 for flattened tube fins of what is called a fin per stroke type, in which one flattened tube fin is formed in a direction (width direction) that is orthogonal to the conveying direction in the same plane within the conveying plane. Note that the same component as that in the above embodiments is denoted by the same reference symbol and the description of such a component may be omitted.

The molded body 9 for flattened tube fins of the fin per stroke type is formed with a plurality of flattened tube fins 8 arranged in the conveying direction, each being long in the width direction of the molded body 9 for flattened tubes.

The tube insertion portions 7 of the flattened tube fin 8 according to the present embodiment are cutaway portions that open to a side surface of each flattened tube fin 8 (that is, a surface on the conveying direction side), and extends long in the conveying direction.

The conveying units 50 are arranged along the conveying direction in the present embodiment. In FIG. 10, two conveying units 50 are provided along the conveying direction. Each conveying unit 50 includes the rotation shaft 54 that rotates in the conveying direction, and the rotary disks 52 along the axial direction of the rotation shaft 54.

On the outer peripheral surface of each of the rotary disks 52, protrusions 52B are formed to protrude outward. Each of the protrusions 52B is formed to have a narrower width toward an upper end, that is, has a tapered shape.

The protrusion 52B according to the present embodiment is narrow in the width direction and wide in the rotation direction, which is different from the protrusion 52A described in the first embodiment. This is because the tube insertion portion 7 is narrow in the width direction and wide in the conveying direction and the protrusion 52B is formed in accordance with such a shape of the tube insertion portion 7.

The side surface shape of the protrusion 52B is a shape to enable the protrusion 52B to enter the tube insertion portion 7 with a space maintained in synchronization with the rotation of the rotation shaft 54, and retract from the tube insertion portion 7 while the protrusion 52B comes in contact with the tube insertion portion 7 and conveys the molded body for flattened tube fins.

In regard to the protrusion 52B to be inserted into the tube insertion portion 7, at least a part of an outer surface of the protrusion 52B that comes to the front side (downstream side in the conveying direction of the molded body for flattened tube fins) in the rotating direction when the rotary disk 52 conveys the molded body 9 for flattened tube fins is formed by an involute curve.

In FIG. 10, however, both a front surface side and a rear surface side of the outer surface of the protrusion 52B are formed by an involute curve.

The shape of the outer surface of the protrusion 52B is not limited to the involute curve.

The front surface side of the outer surface of the protrusion 52B is formed by the involute curve. Thus, when the rotary disk 52 is rotated to make the protrusion 52B enter the tube insertion portion 7 gradually, the contact resistance between the outer surface of the protrusion 52B and an inner wall surface of the tube insertion portion 7 can be reduced to enable the smooth entry of the protrusion 52B.

In addition, when the protrusion 52B retracts from the tube insertion portion 7 by the rotation of the rotary disk 52, the contact resistance between the outer surface of the protrusion 52B and the inner wall surface of the tube insertion portion 7 can be reduced to enable the smooth retraction of the protrusion 52B.

Figure 11:
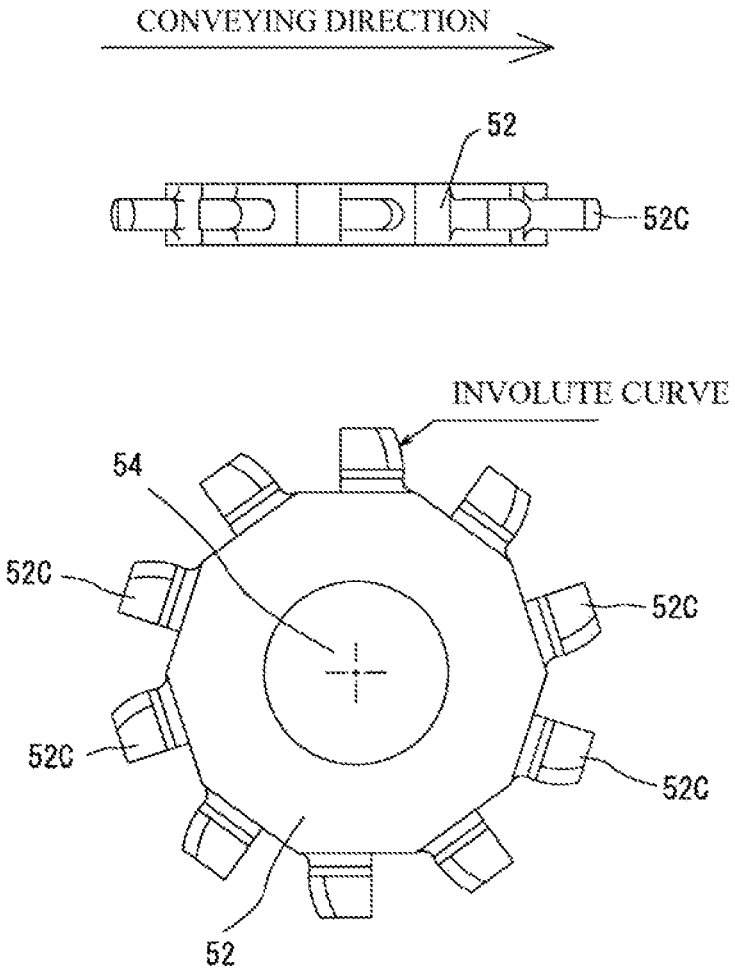
FIG. 11 is an explanatory view illustrating an example of another shape of a protrusion according to the third embodiment.
Figure 12:
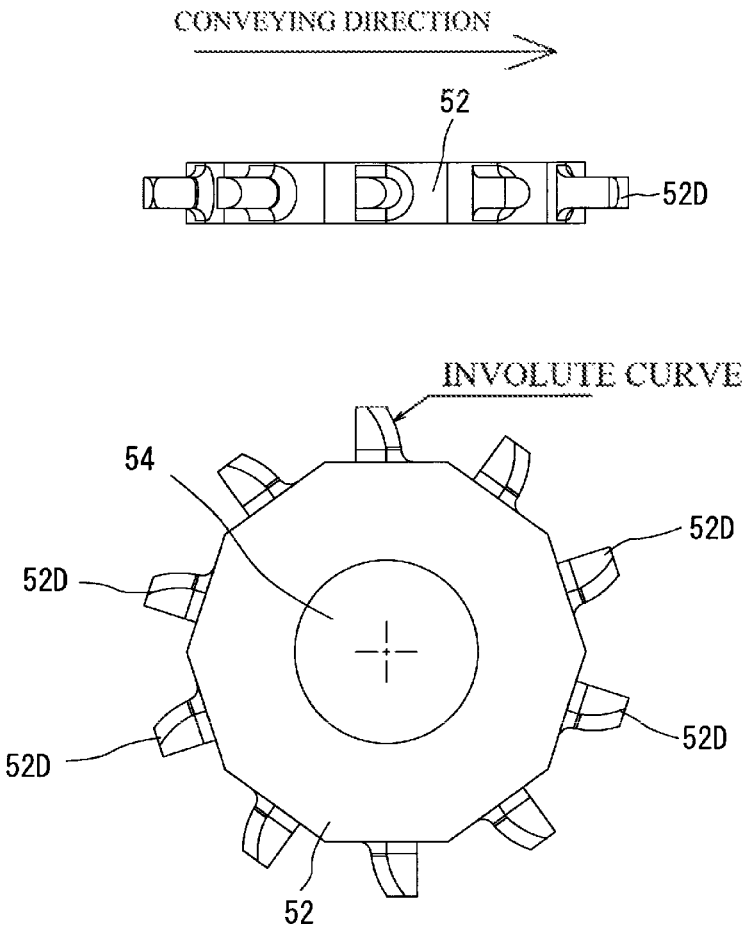
FIG. 12 is an explanatory view illustrating an example of another shape of the protrusion according to the third embodiment.

FIG. 11 and FIG. 12 illustrate other shapes of rotary disks for conveying the molded body 9 for flattened tube fins of the fin per stroke type.

In FIG. 11, an outer surface of a front surface side of each protrusion 52C of the rotary disk 52 is formed by an involute curve, and an outer surface of a rear surface side of the protrusion 52C is formed by a flat plane to be extended toward a center of rotation of the rotary disk 52. This shape is formed by the involute curve on at least the front surface side in the conveying direction; therefore, the entry and retraction of the protrusion 52C in and out of the tube insertion portion 7 can be smoothly performed. The outer surface of the rear surface side of the protrusion 52C is a plane and not the curve. It is difficult to form the involute curve but forming such a shape facilitates the processing of the rotary disk 52.

Similar to FIG. 11, an outer surface of a front surface side of each protrusion 52D of the rotary disk 52 in FIG. 12 is formed by an involute curve, and an outer surface of a rear surface side of the protrusion 52D is formed by a flat plane to be extended toward a center of the rotation of the rotary disk 52. The length of the protrusion 52D in the rotation direction is however approximately a half of the length in the conveying direction of the tube insertion portion 7 to which the protrusion 52D is to be inserted. This shape is formed by the involute curve on at least the front surface side in the conveying direction: therefore, the entry and retraction of the protrusion 52D in and out of the tube insertion portion 7 can be smoothly performed. The outer surface of the rear surface side of the protrusion 52D is a plane, allowing for easy processing of the rotary disk 52.

In the apparatus 100 for manufacturing flattened tube fins of the fin per stroke type, the cutting into the product width along the conveying direction is not performed and therefore, the installation of the inter-row slit device 70 can be omitted. In addition, the rotary conveying body 56 may employ the appropriate mode in accordance with the mode of the flattened tube fins to manufacture.

Fourth Embodiment

In each embodiment described above, the servomotor is employed as the rotary conveying body driving unit 58 that rotates and drives the rotary conveying body 56.

The rotary conveying body driving unit 58 may alternatively be a crank shaft of the mold press unit 20.

Figure 13:
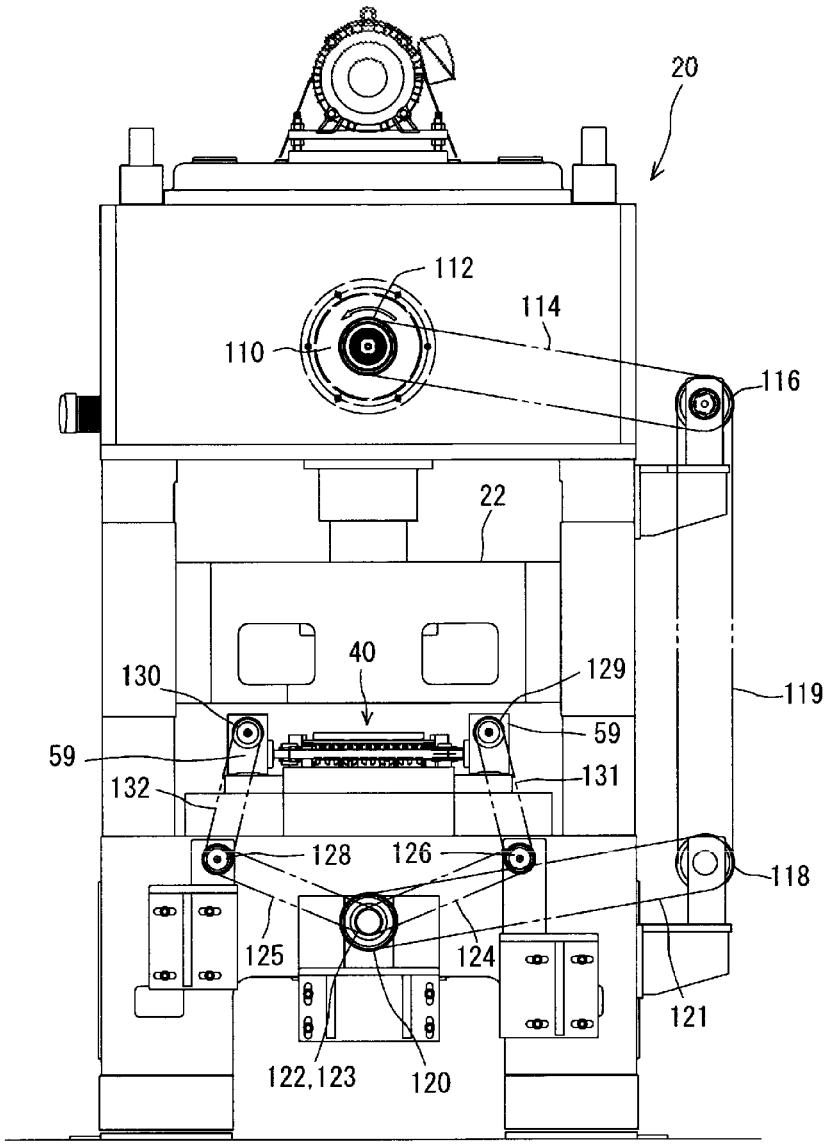
FIG. 13 is a front view of a metal press unit according to a fourth embodiment.
Figure 14:
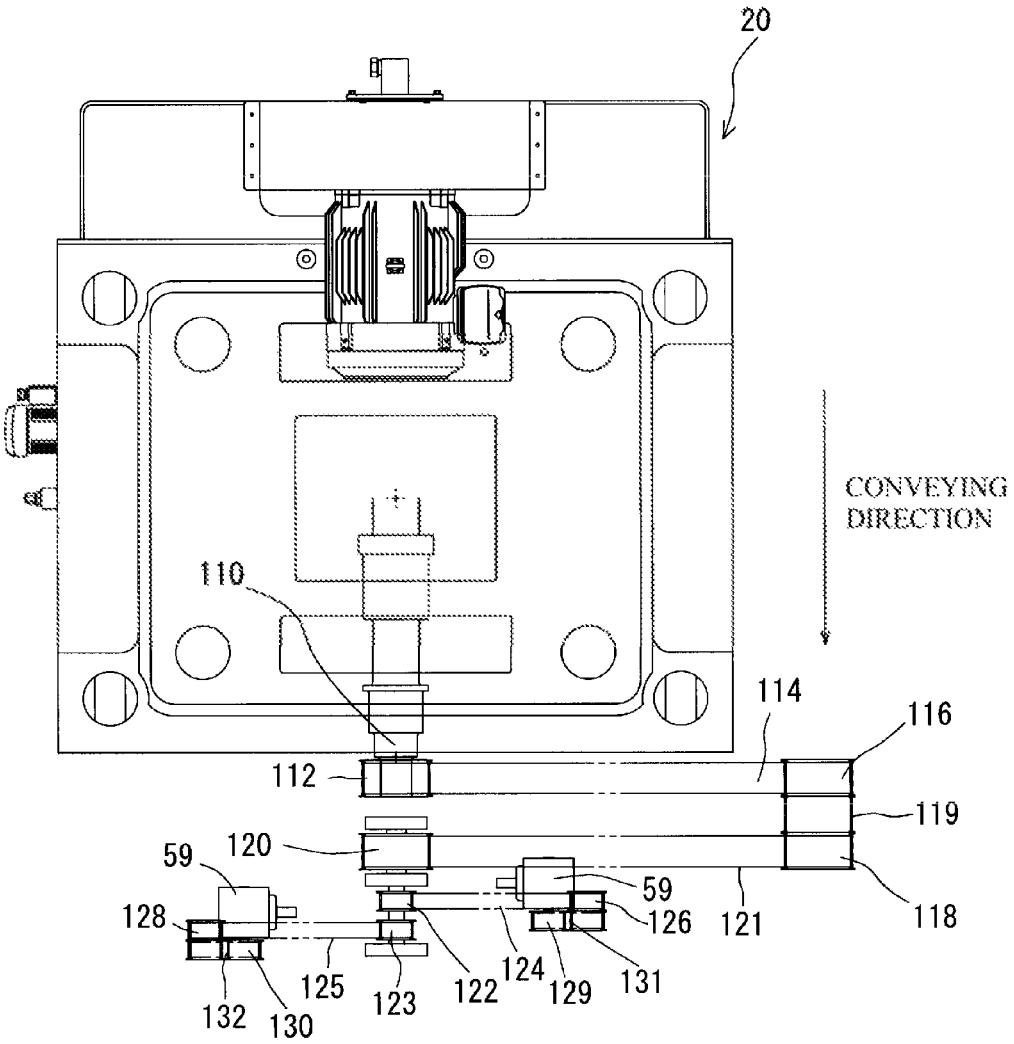
FIG. 14 is a plan view of the metal press unit according to the fourth embodiment.
Figure 15:
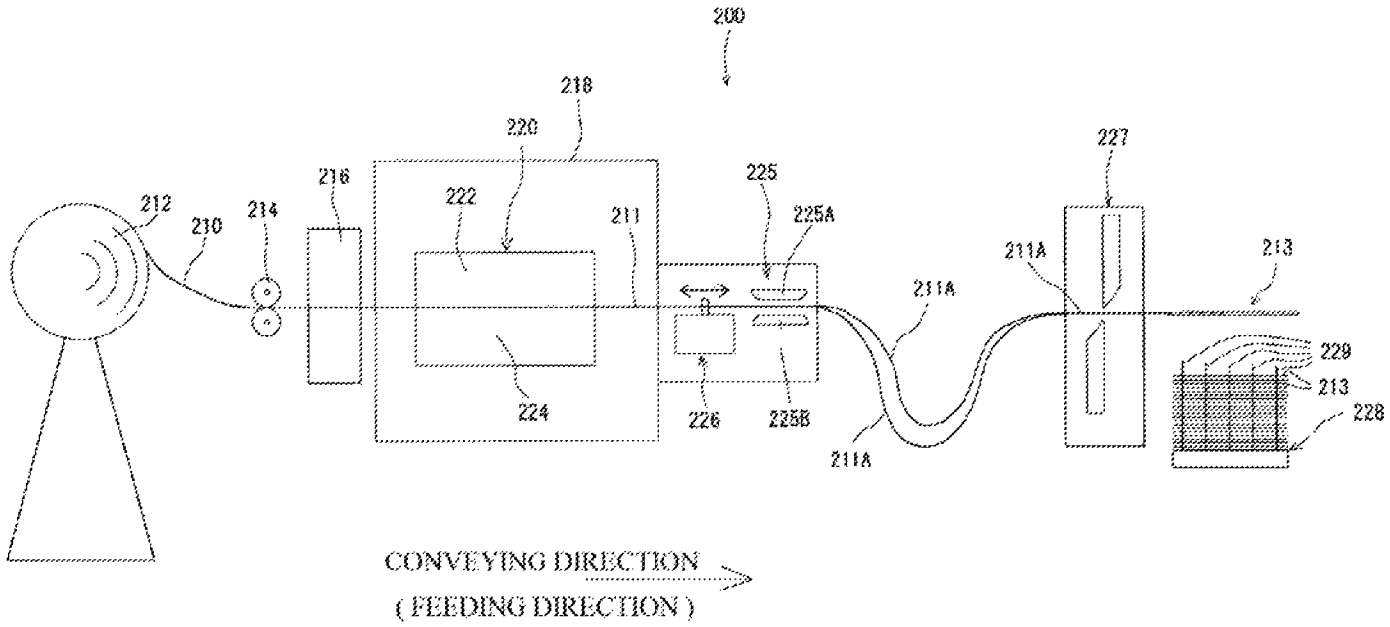
FIG. 15 is a side view of an apparatus for manufacturing heat exchanger fins in a conventional technique.

This embodiment is described with reference to FIGS. 13 and 14. FIG. 13 is a front view in which the apparatus 100 for manufacturing flattened tube fins is viewed from the downstream side in the conveying direction, and FIG. 14 is a plan view of the apparatus 100 for manufacturing flattened tube fins.

The mold press unit 20 of the apparatus 100 for manufacturing flattened tube fins includes a driving device (not illustrated) that moves up and down the upper die set 22A of the mold 22, and a pulley 112 is provided on an axial line of a crank shaft 110 included in the driving device. By a plurality of timing belts that extend from the pulley 112 through a plurality of pulleys, a rotating and driving force is input to each input shaft of two cam indexes 59.

At a side surface of the mold press unit 20, two pulleys 116 and 118 are disposed vertically. A first timing belt 114 is stretched between the pulley 116 and the pulley 112 of the crank shaft 110. The pulley 116 is among the pulleys at the side surface and positioned on an upper part.

Between the pulley 118 and the pulley 116 on the upper part, a second timing belt 119 is stretched. The pulley 118 is among the pulleys at the side surface and positioned on a lower part.

In addition, below the downstream side of the conveying direction of the conveying apparatus 4, a pulley 120 is provided. Between the pulley 120 and the pulley 118 on the lower part at the side surface, a third timing belt 121 is stretched.

A rotation shaft of the pulley 120 is further provided with two pulleys 122 and 123. A side surface side of the pulley 122 is provided with a pulley 126, and another side surface side of the pulley 123 is provided with a pulley 128.

Between the pulley 122 and the pulley 126, a fourth timing belt 124 is stretched. An input shaft of the cam index 59 on the right side in FIG. 13 is also provided with a pulley 129, and between the pulley 126 and the pulley 129 of the cam index 59 on the right side, a fifth timing belt 131 is stretched.

In this manner, the rotating and driving force of the crank shaft 110 is input to the input shaft of the cam index 59 on the right side.

Between the pulley 123 and the pulley 128, a sixth timing belt 125 is stretched. An input shaft of the cam index 59 on the left side in FIG. 13 is also provided with a pulley 130, and between the pulley 128 and the pulley 130 of the cam index 59 on the left side, a seventh timing belt 132 is stretched.

In this manner, the rotating and driving force of the crank shaft 110 is input to the input shaft of the cam index 59 on the left side.

In the present embodiment, in a case where the rotary conveying body 56 is rotated and driven by using the press motive power from the mold press unit 20 instead of using the motor, the conventional hitch feeding mechanism is not necessary, whereby generation of noise and damage on the components can be prevented and the molded body 30 for flattened tube fins can be conveyed at high speed.

Although the two conveying units 50 are provided in the conveying apparatus 40 in the above embodiments, the present invention is not limited to this example. In other words, the conveying apparatus 40 may include three or more conveying units 50 (not illustrated) that are disposed along the conveying direction of the molded body 30 for flattened tube fins. The conveying apparatus 40 may alternatively include only one conveying unit 50 (not illustrated).

The conveying units 50 are not necessarily disposed at equal intervals, and it is only necessary that the conveying units 50 are disposed in accordance with the intervals of the products of the molded body 30 for flattened tube fins. In short, it is only necessary that the operation control unit 90 performs the operation control so that the rotation operations (rotation speeds) of the rotation conveying bodies 56 of the conveying units 50 of the conveying apparatus 40 are in synchronization.

In the above embodiments, the rotation conveying body 56 has the structure in which the rotary disk 52 provided with the protrusions 52A is attached to the rotation shaft 54. However, the rotary conveying body 56 may have a structure in which the outer peripheral surface of the rotation shaft 54 has an uneven shape (shape with large-diameter parts and small-diameter parts) and the convex parts (large-diameter parts) function as the protrusions 52A.

Furthermore, in the above description, at the end of one cycle operation of intermittently feeding the molded body 30 for flattened tube fins in the apparatus 100 for manufacturing flattened tube fins, the entering angle of the protrusion 52A to enter the tube insertion portion 31 of the molded body 30 for flattened tube fins is set so that the protrusion 52A stands up in the direction orthogonal direction of the conveying plane; however, the present invention is not limited to this example. In regard to the entering angle of the protrusion 52A to enter the tube insertion portion 31 of the molded body 30 for flattened tube fins, at the restart of conveying the molded body 30 for flattened tube fins, the angle range that does not deform the tube insertion portion 31 by the restart of the rotation and driving of the protrusion 52A is calculated in advance in accordance with the material and the plate thickness of the molded body 30 for flattened tube fins, and the entering angle may be set in the calculated angle range.

In another example, the cam index 59 may be unused when the rotation shaft 54 and the rotary conveying body driving units 58 are connected in the conveying unit 50, and the operation control unit 90 may perform the operation control of the rotary conveying body driving unit 58 so that the rotating and driving operation of the rotary conveying body driving unit 58 and the press operation of the mold press unit 20 (operation of intermittently feeding the molded body 30 for flattened tube fins) are in synchronization.

The apparatus 100 for manufacturing flattened tube fins may employ the embodiments and modifications described above in combination as appropriate.

What is claimed is:

1. An apparatus for conveying a molded body for flattened tube fins that, in manufacturing flattened tube fins having cutaway portions through which flattened tubes for exchanging heat are inserted, conveys in a predetermined direction a molded body for flattened tube fins obtained by providing a metal thin plate with the cutaway portions, before the metal thin plate is cut into a predetermined length in a conveying direction, the apparatus for conveying a molded body for flattened tube fins comprising:

a rotary conveying body including a plurality of protrusions that are tapered and able to enter the cutaway portions, and including a rotation shaft in a direction orthogonal to the conveying direction of the molded body for flattened tube fins in a horizontal plane; and a rotary conveying body driving unit that rotates and drives the rotary conveying body about the rotation shaft, and a lower guide plate that supports a lower surface of the molded body for flattened tube fins, and an upper guide plate that covers an upper surface of the molded body for flattened tube fins, wherein a lower surface of the upper guide plate has a convex part that protrudes downward at a corresponding position in the flat area of the molded body for flattened tube fins, and wherein a side surface shape of each of the protrusions is formed to have a shape to enable the protrusion to enter the corresponding cutaway portion with a space maintained in synchronization with a rotation of the rotation shaft, and retract from the cutaway portion while the protrusion comes in contact with the cutaway portion and conveys the molded body for flattened tube fins.

2. The apparatus for conveying a molded body for flattened tube fins according to claim 1, wherein at least a part of the side surface shape of the protrusion is formed by an involute curve.

3. The apparatus for conveying a molded body for flattened tube fins according to claim 2, wherein the rotary conveying body driving unit is a servomotor, and the servomotor has a rotation shaft that is directly connected to the rotation shaft of the rotary conveying body.

4. The apparatus for conveying a molded body for flattened tube fins according to claim 1, wherein the rotary conveying body driving unit is a servomotor, and the servomotor has a rotation shaft that is directly connected to the rotation shaft of the rotary conveying body.

5. The apparatus for conveying a molded body for flattened tube fins according to claim 1, wherein the rotary conveying body driving unit uses, as a motive power source, rotation motive power from a crank shaft that performs a mold pressing operation of a mold for forming the cutaway portions.

* * * * *